US007869744B2

(12) United States Patent
Lee

(10) Patent No.: US 7,869,744 B2
(45) Date of Patent: Jan. 11, 2011

(54) IMAGING APPARATUS AND IMAGE FORMING METHODS

(75) Inventor: Michael H. Lee, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 920 days.

(21) Appl. No.: 11/106,876

(22) Filed: Apr. 14, 2005

(65) Prior Publication Data

US 2006/0233570 A1 Oct. 19, 2006

(51) Int. Cl.
*G03G 15/01* (2006.01)

(52) U.S. Cl. ..... 399/226; 399/227; 399/228

(58) Field of Classification Search ..... 399/222–233, 399/237–240

See application file for complete search history.

(56) References Cited

U.S. PATENT DOCUMENTS 5,083,164 A * 1/1992 Kamath et al. ..... 399/226
5,737,666 A * 4/1998 Lior et al. ..... 399/57
6,647,232 B2 * 11/2003 Suzuki ..... 399/227

OTHER PUBLICATIONS

"2,540 dpi Full Color Image Creation with a Liquid Electrophotography System"; Ishii et al.; IS&T's NIP:2003 Int'l Conference on Digital Printing Technologies; 2003; pp. 9-12.

* cited by examiner

*Primary Examiner*—David P Porta
*Assistant Examiner*—Bryan P Ready

(57) ABSTRACT

Imaging apparatuses and Image forming methods are described. According to one embodiment, an imaging apparatus includes a photoconductor including an image forming surface configured to receive a latent image, a plurality of developers individually configured to provide a marking agent to the image forming surface to develop the latent image, wherein one of the developers is configured to move in a first direction with respect to the image forming surface to implement development of the latent image by the one of the developers and an other of the developers is configured to move in a second direction different than the first direction to implement development of the latent image by the other of the developers, and wherein the photoconductor is configured to provide the developed image for transfer to media after the development of the latent image by the one and other developers.

42 Claims, 6 Drawing Sheets

IMAGING APPARATUS AND IMAGE FORMING METHODS

FIELD OF THE DISCLOSURE

This disclosure relates to imaging apparatuses and image forming methods.

BACKGROUND OF THE DISCLOSURE

Color electrophotographic (EP) printers can be implemented in several different configurations. One large class of electrophotographic printers includes those that have the ability to develop the final image at nearly the same process speed as that of a single developer. These are "single-pass" or "tandem" printers, which use one photoconductor (PC) and one developer for each color as shown in FIG. 1. In this configuration, photoconductors 10-13 contact a separate region of a transfer drum or belt 14. Developers 15-18 respectively develop latent images on photoconductors 10-13. As in electrophotography, each developer tones the latent image on a respective photoconductor, and the toner may be subsequently transferred to an intermediate 14 such as a transfer belt or drum. The development is timed so that as the first image on the intermediate 14 arrives under the second photoconductor, the two color separations are aligned. This sequence-continues, color by color, until the image is complete. The toner is then transferred in one step to the desired media. Since the imaging process for each color is independent, the media can be sent through, one after another, with a minimal gap in between the sheets of media. Thus, the printer process speed is close to that of a single developer. Other embodiments of single-pass printers may provide developed images upon media without an intermediate.

Another class of electrophotographic printers includes those that develop the image on a single photoconductor in a sequence and may be referred to as "multi-pass" color printers. In these configurations, all of the colors are transferred to the substrate one by one before the next piece of media can be sent through. Accordingly, for a four-color printer, the process speed of the printer will be approximately one-fourth that of the developer. Although the multi-pass printer is considerably slower than the single-pass at the same developer speed, the multi-pass configuration has certain advantages. For example, a lower cost is possible since only a single charging and imaging system is utilized. Further, in at least one multi-pass system, all colors are provided to the photoconductor before application to the media substrate. Color plane alignment is generally improved compared with a single-pass system where the images on different drums are aligned with one another.

In a second variation of a multi-pass printer, the image is transferred to an intermediate, such as a belt. However, the plane-to-plane registration can be relatively poor for a belt embodiment. If the transfer is to an intermediate drum, the registration can approach results achievable with the above-mentioned accumulating photoconductor drum.

Some multi-pass embodiments enable the use of a relatively small photoconductor and which can have reduced cost if implemented as an organic imaging region using "beer can" dip-coat technology. To the contrary, photoconductor drums of relatively increased size are typically machined from aluminum to retain sufficient rigidity. The final product therefore is more costly regardless of whether the imaging region is organic or amorphous silicon (a-Si), for example.

Referring to FIG. 2, a multi-pass color printer configuration may include a rotating carousel 20 which houses several developers (not shown). The first developer is placed adjacent to the photoconductor 21 for development of a latent image. The developed image can then be transferred to an intermediate or retained in place for subsequent layers. After the first layer is developed, the second developer is rotated into place. Development continues until all the colors are deposited on the photoconductor or the intermediate.

Referring to FIG. 3, another configuration provides a multi-pass printer implemented with developers 30-33 aligned around a periphery of the photoconductor 34. Unlike the carousel arrangement described above, individual developers advance towards photoconductor 34 to develop an image (i.e., developer 33 shown in FIG. 3) and retract after development (i.e., developers 30-32 in FIG. 3). The configuration of FIG. 3 saves time between development of colors and enables utilization of a more straightforward developer design since the developer housings are not rotated.

While the peripheral-developer multi-pass configuration of FIG. 3 described above offers advantages over the carousel configuration of FIG. 2, the configuration of FIG. 3 has associated drawbacks of utilizing a relatively large photoconductor to accommodate the developers provided around the periphery. In addition, room around the periphery is provided for cleaner, charger and imager systems, as well as dead space enabling the photoconductor to respond to imaging light. Accordingly, compared to the single-pass color printer of FIG. 1, the photoconductor of the peripheral-developer multi-pass color printer of FIG. 3 is typically larger in diameter. In the embodiment of FIG. 3, it is common to provide a photoconductor of sufficient size to receive an entire image for color development. In some embodiments, the photoconductor length may be increased to twice the media size to simultaneously accommodate two images.

Although use of a large photoconductor of a peripheral-developer multi-pass printer may appear to be a costly disadvantage, there are instances where the configuration of FIG. 3 is worthwhile. For example, a six-color printer, useful for high quality photographs, utilizes two additional developers, and if a carousel is implemented, the extra developer modules may render the developer assembly rather unwieldy. The photoconductor drum of the embodiment of FIG. 3 may be sized to accommodate the additional developers. However, at some point, the photoconductor drum even in the configuration of FIG. 3 may become too large for cost effective fabrication.

At least some aspects of the disclosure provide improved methods and apparatus for generating images upon media.

SUMMARY

According to some aspects, imaging apparatuses and image forming methods are described.

In one aspect, an imaging apparatus comprises a photoconductor comprising an image forming surface configured to receive a latent image, a plurality of developers individually configured to provide a marking agent to the image forming surface to develop the latent image, wherein one of the developers is configured to move in a first direction with respect to the image forming surface to implement development of the latent image by the one of the developers and an other of the developers is configured to move in a second direction different than the first direction to implement development of the latent image by the other of the developers, and wherein the photoconductor is configured to provide the developed image for transfer to media after the development of the latent image by the one and other developers.

In another aspect, the disclosure provides an imaging apparatus comprising an image forming surface for forming a latent electrostatic image. The apparatus may include a plurality of developer surfaces adapted for operative engagement with the image forming surface at a first development region which is fixed in a spatial position. A plurality of developers may be included, each comprising one of the developer surfaces to transfer the toner from the respective developer surface to the image forming surface to form a developed image on the image forming surface. The plurality of developers may be linearly arranged when disengaged and adapted to move with respect to the image forming surface to sequentially bring each of the plurality of developer surfaces into operative engagement with the image forming surface at the first development region.

DETAILED DESCRIPTION

Aspects of the disclosure provide imaging apparatuses and image forming methods.

Figure 1:
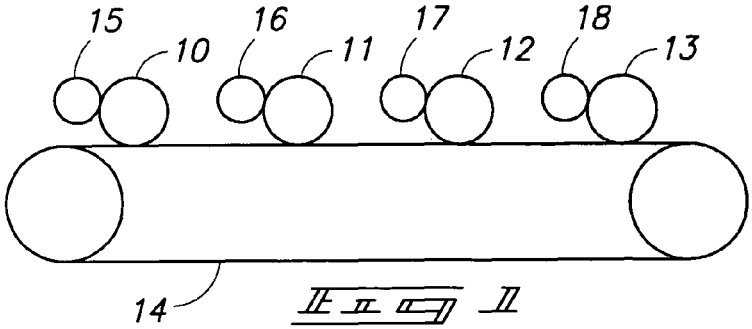
Fig 1 PRIOR ART
FIG. 1 is an illustrative representation of a single-pass engine.
Figure 2:
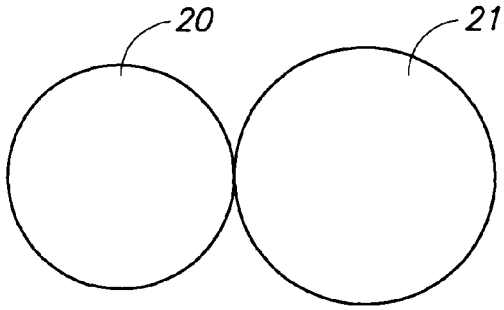
Fig 2 PRIOR ART
FIG. 2 is an illustrative representation of a four-color rotating carousel developer.
Figure 3:
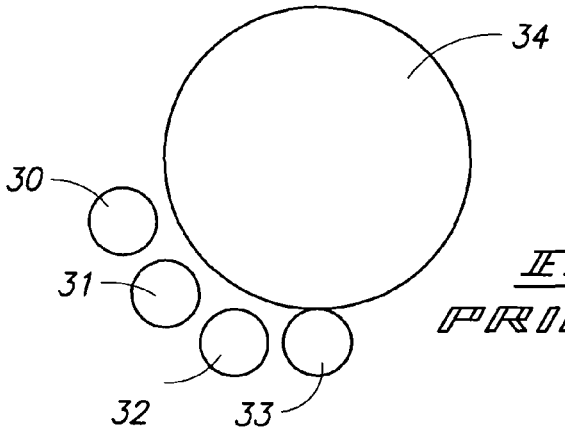
Fig 3 PRIOR ART
FIG. 3 is an illustrative representation of a peripheral-developer multi-pass configuration.
Figure 4:
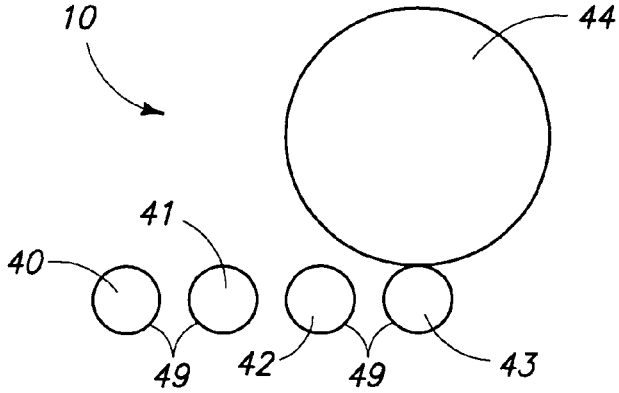
FIG. 4 is an illustrative representation of a multi-pass configuration with shuttle developers in accordance with one embodiment.
Figure 5:
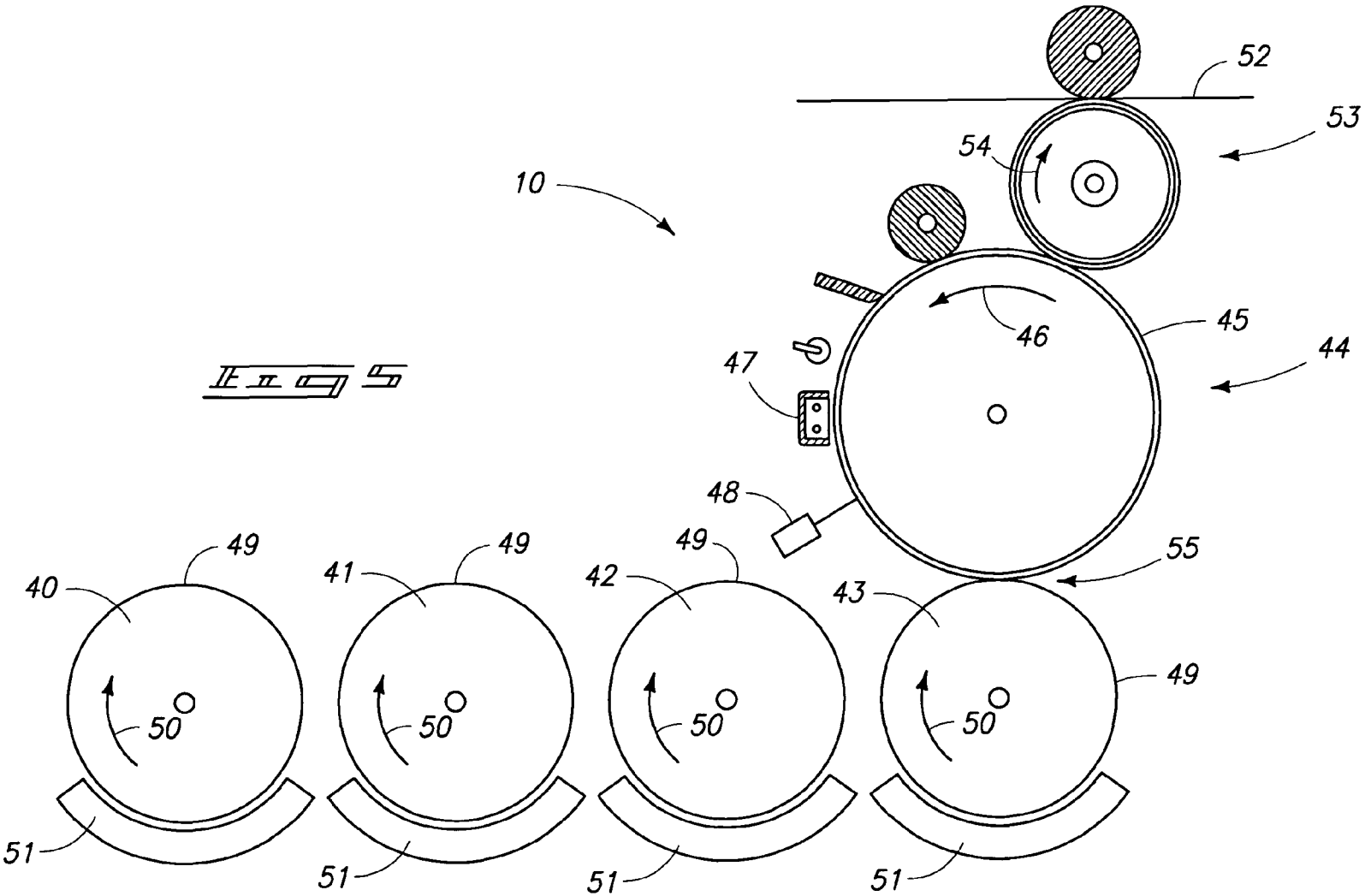
FIG. 5 is another illustrative representation of the developer assembly shown in FIG. 4.

Referring to FIG. 4, components of a latent development multi-pass imaging apparatus 10 are illustrated in accordance with one embodiment of the disclosure. A more detailed diagram of the apparatus 10 is illustrated in FIG. 5. Imaging apparatus 10 is embodied as a printer in one implementation.

In FIG. 4, the printer consists of several developer rollers 40-43, and a photoconductor drum 44. Each developer roller 40-43 is provided with a developer surface 49. In this embodiment of the disclosure, the developer rollers 40-43, and respective developer surfaces 49, are arranged to sequentially engage the photoconductor drum 44 such that development occurs at a fixed region or position relative to the placement of the photoconductor drum 44. In FIG. 4, this development region is at the six-o'clock position of the photoconductor drum 44.

In FIG. 5, the printer includes photoconductor drum 44 having a cylindrical photoreceptor surface 45 made of a selenium compound or an organic in some embodiments. During operation, photoconductor drum 44 rotates in the direction indicated by arrow 46 and photoreceptor surface 45 is charged by a surface charger 47 to a generally uniformly predetermined voltage, typically on the order of 1000 Volts. Surface charger 47 may be any type of charger known in the art, such as a corotron, a scrorotron or a roller.

Continued rotation of photoconductor drum 44 brings photoreceptor surface 45 into image receiving relationship with an exposure device such as a light source 48, which may be a laser scanner (in the case of a printer) or the projection of an original (in the case of a photocopier). Light source 48 forms a desired latent image on charged photoreceptor surface 45 by selectively discharging a portion of the photoreceptor surface, the image portions being at a first voltage and the background portions at a second voltage. The discharged portions may have a voltage of less than about 100 Volts.

Continued rotation of photoconductor drum 44 brings the selectively charged photoreceptor surface 45 into operative contact engagement with the developer surface 49 of a first developer roller 43 at the development region 55. As shown, first developer roller 43 is one of a set of four developer rollers. It will be appreciated that less or more than four developer rollers may be provided in other embodiments (e.g., depending on the number of colors to be printed).

First developer roller 43 rotates in a direction opposite that of photoconductor drum 44 as shown by arrow 50 in one embodiment. First developer roller 43 may be urged against photoconductor drum 44. First developer roller 43 may be formed with a metal core coated with a soft elastomer material, or formed with any other suitable construction and/or materials.

Each of the developer rollers 40-43 may be adjacent to a respective applicator assembly generally indicated by reference numeral 51. Each applicator assembly 51 may include a toner dispenser (not shown) and applicator roller (not shown), and solid or liquid toner may be coated onto the respective developer by electrophoresis.

The developed image may be directly transferred to a media or substrate 52, such as paper, from photoreceptor surface 45 in one embodiment. Alternatively, as shown in FIG. 5, an intermediate transfer member 53 (e.g., a drum or belt) may be provided in operative engagement with photoreceptor surface 45 of photoconductor drum 44 to transfer the developed image to the substrate 52. In the illustrated embodiment, intermediate transfer member 53 rotates in a direction opposite to that of photoreceptor surface 45 as shown by arrow 54 and there is substantially zero relative motion between the respective surfaces at the point of image transfer.

As printing starts, the first developer 43 sits in the development position at the development region 55 of photoconductor drum 44 while the others wait in non-development positions. After the first color is laid down on photoreceptor surface 45 by the first developer 43, the first developer roller 43 and second developer roller 42 are moved so that the second developer roller 42 can develop at the same development region 55. In one embodiment, developer rollers 40-43 are moved at the same time. In another embodiment, for example to save power, only the developer roller just used and the next developer roller may initially be moved. Thereafter, the third developer roller 41 may move while development using the second developer 42 takes place.

Figure 6:
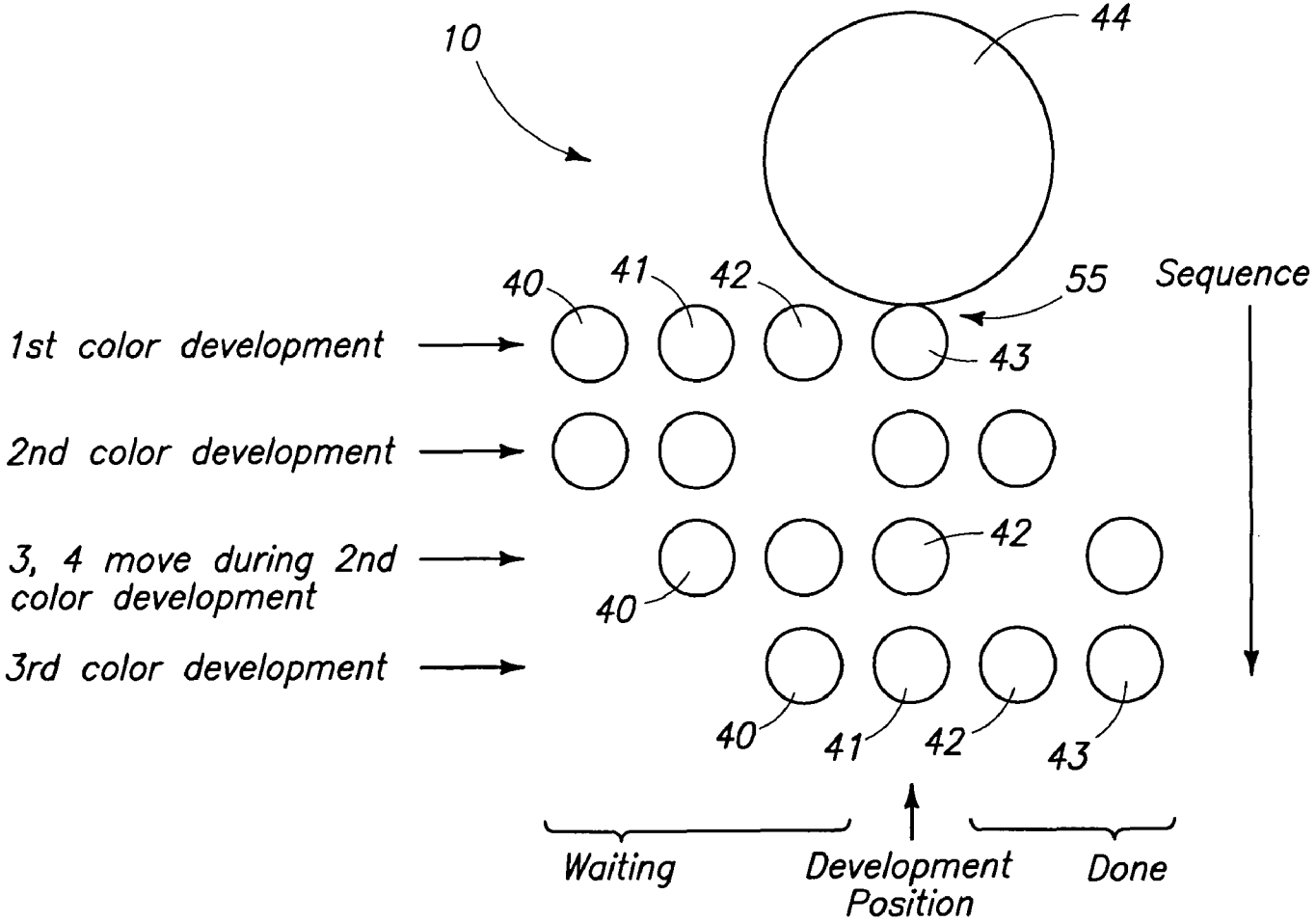
FIG. 6 is a diagram illustrating shuttle movement of the developers shown in FIG. 4 according to one embodiment.

One exemplary operational sequence is shown in FIG. 6 according to one embodiment. The first color is developed by first developer roller 43. When complete, first developer roller 43 and second developer roller 42 shuttle to bring the second developer roller 42 to the development region 55. While the second color is being developed, third and fourth development rollers, 41, 40, shuttle alongside second developer roller 42, waiting to move into the development position 55 and first developer roller 43 shuttles further along one space. When the second color is complete, second developer roller 42 shuttles alongside first developer roller 43, and third and fourth developer rollers 41, 40 shuttle further such that the third developer roller 41 is in the development position. This sequence continues until all colors are developed.

It will be appreciated that this exemplary shuttle-developer system has several advantages. First, the size of the photoconductor drum 44 is largely independent of the number of developer rollers and can be smaller than other peripheral-develop printer arrangements with comparable specifications. Where the photoconductor drum 44 is sufficiently small, a beer-can, dipped-coated organic photoconductor drum 44 can be used if appropriate. Even where the photoconductor drum 44 size is relatively large, it would still be considerably smaller than with usage of peripheral developers. Secondly, the developers can be aligned to substantially the same vertical in one embodiment simplifying design for orientation-sensitive developers, such as those that use a liquid marking agent. Thirdly, development for all colors occurs at the same time after charging and imaging which is advantageous in some embodiments (e.g., usage with photoconductors with fast dark decays, such as a Si).

Figure 7:
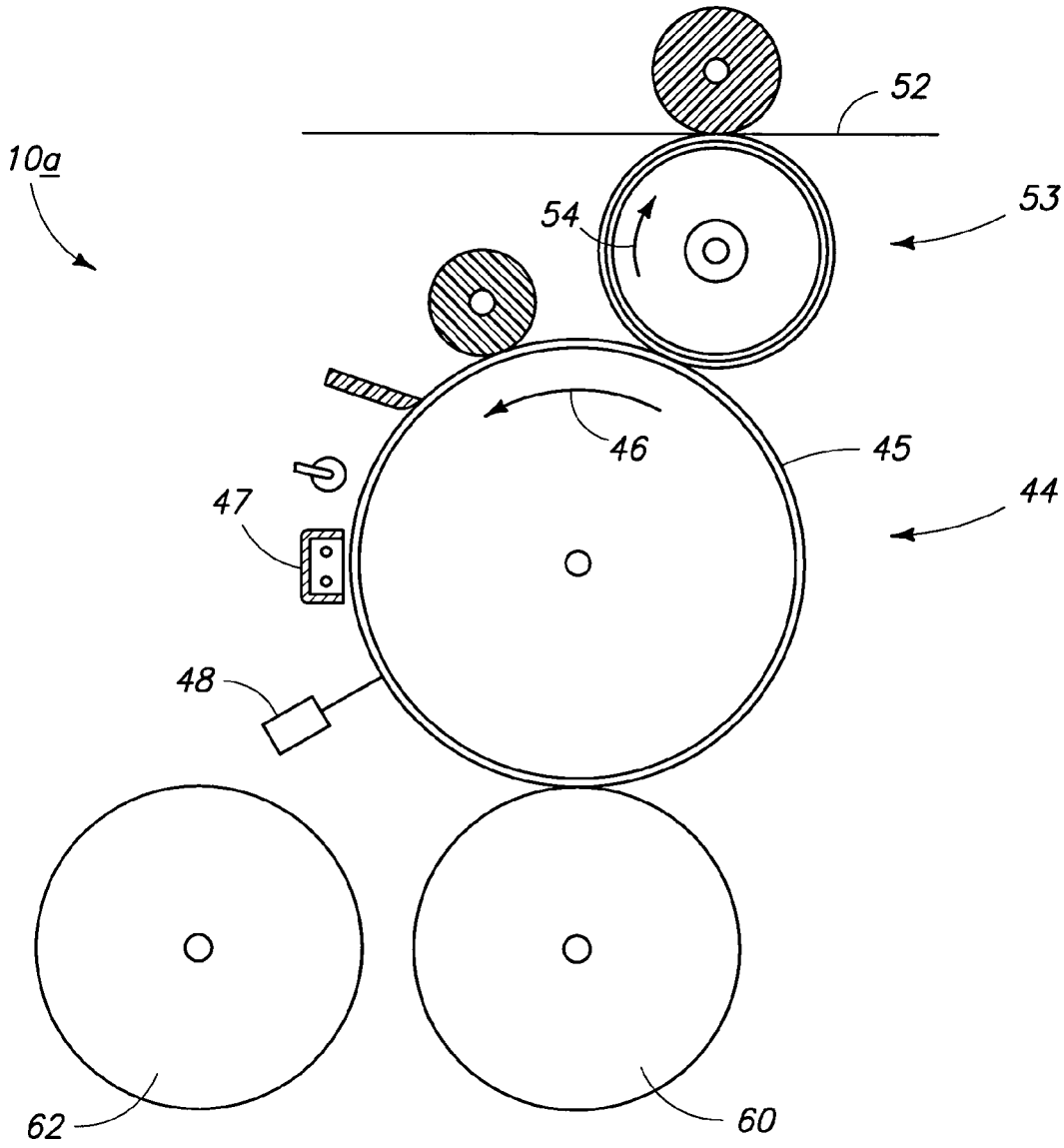
FIG. 7 is an illustrative representation of a multi-pass configuration according to one embodiment.
Figure 8:
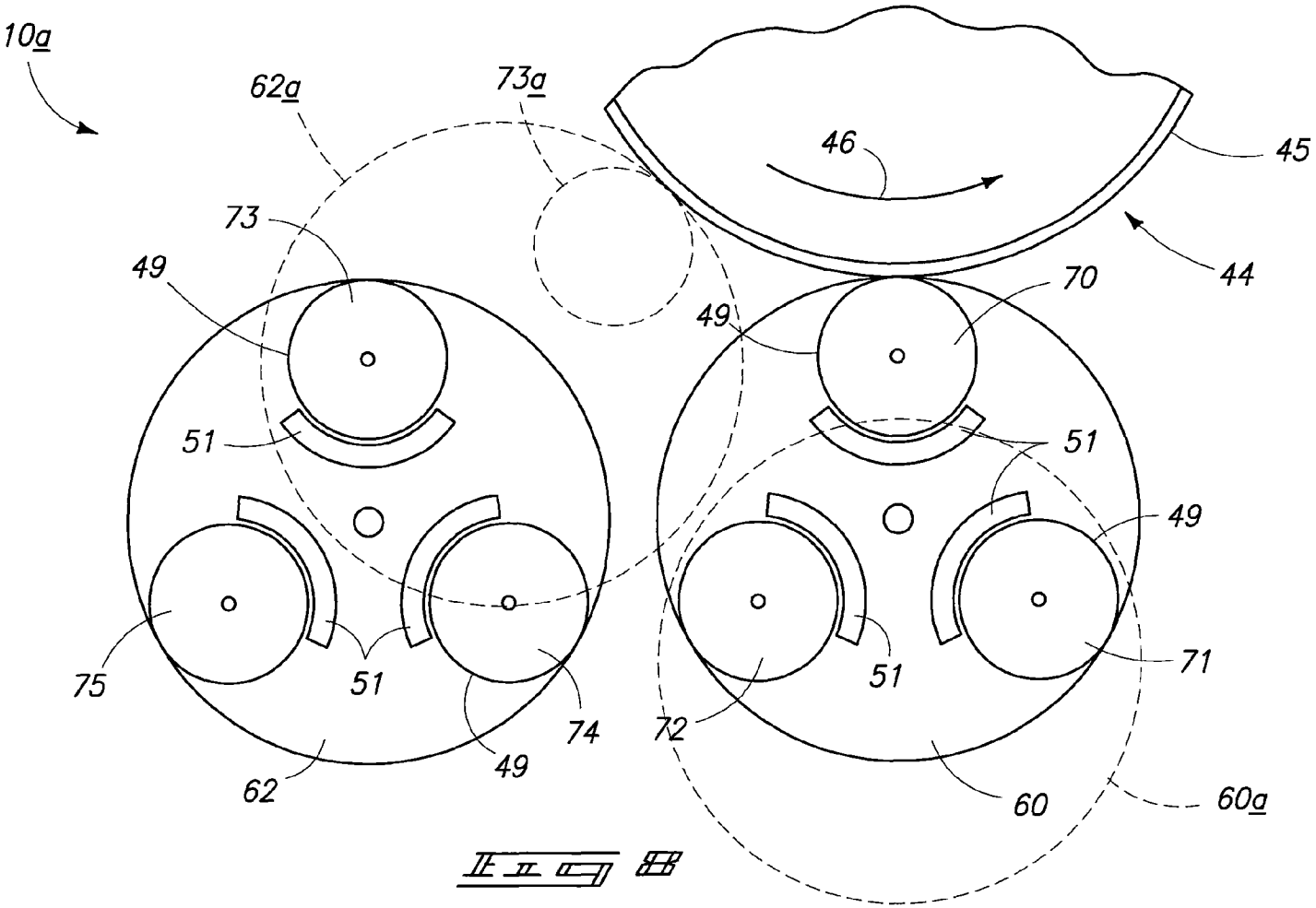
FIG. 8 is another illustrative representation of the developer assembly shown in FIG. 7.

Aspects of another embodiment of apparatus 10*a* are illustrated in FIGS. 7 and 8 wherein like reference numerals represent like parts or components. This embodiment of the disclosure may retain the advantages described in relation to the previously described embodiment of the disclosure, and has additional advantages of reducing the latent period during which no development takes place while the developer rollers reposition. This additional advantage is achieved by providing two sets of developer rollers, in respective rotating carousels 60, 62, as illustrated in FIG. 7, and shown in more detail in FIG. 8.

Carousels 60 and 62 individually mount a set of developer rollers. Carousels 60 and 62 are adapted to shuttle between an operative or development position adjacent photoconductor drum 44, and an inoperative position. When in an inoperative position, the inoperative carousel 60, 62 may rotate in order to change the orientation of the developer rollers in readiness for development of the next color.

Development on the photoreceptor surface 45 alternates between carousel 60 and carousel 62. For a four-color printer, each carousel 60, 62 has two developer rollers. For a six-color printer, as illustrated in FIG. 8, each carousel 60, 62 has three developer rollers. During printing, the first color of carousel 60 is developed by developer 70. Carousel 60 then moves to an inoperative position (shown by 60*a*) as carousel 62 moves to the development position (shown by 62*a*). Printing using the first color 73*a* of carousel 62 follows. While the first color 73*a* of carousel 62 is developing, the developers 70-72 on carousel 60 are rotated so that the second color 71 is ready to develop from the same position as the first color 70 when the first color 73*a* of carousel 62 finishes. As the second color 71 of carousel 60 develops, the developers 73-75 of carousel 62 are rotated so that the second color 74 is ready to develop. This process continues until all the colors are complete in the described embodiment.

In one embodiment, carousels 60 and 62 are placed close to each other to minimize distance therebetween. This reduces the space in the printer taken by the developer-carousels 60, 62 and photoconductor drum 44 to as little as one third that of an in-line, six-color carousel. For a photoconductor with a relatively fast dark decay, the shorter distance can also reduce the voltage loss by up to two-thirds.

It will be appreciated that the use of two development regions with plural carousels 60, 62 enables the developing time to be decreased since the cumulative shuttling time of the two carousel assemblies is reduced. For example, while a first color is being developed at a first development region, a fourth color can be shuttled to the second development region in preparation for engagement with the photoconductor. Similarly, while a fourth color is being developed, a second color is moved to the printing position at the first development region.

Figure 9:
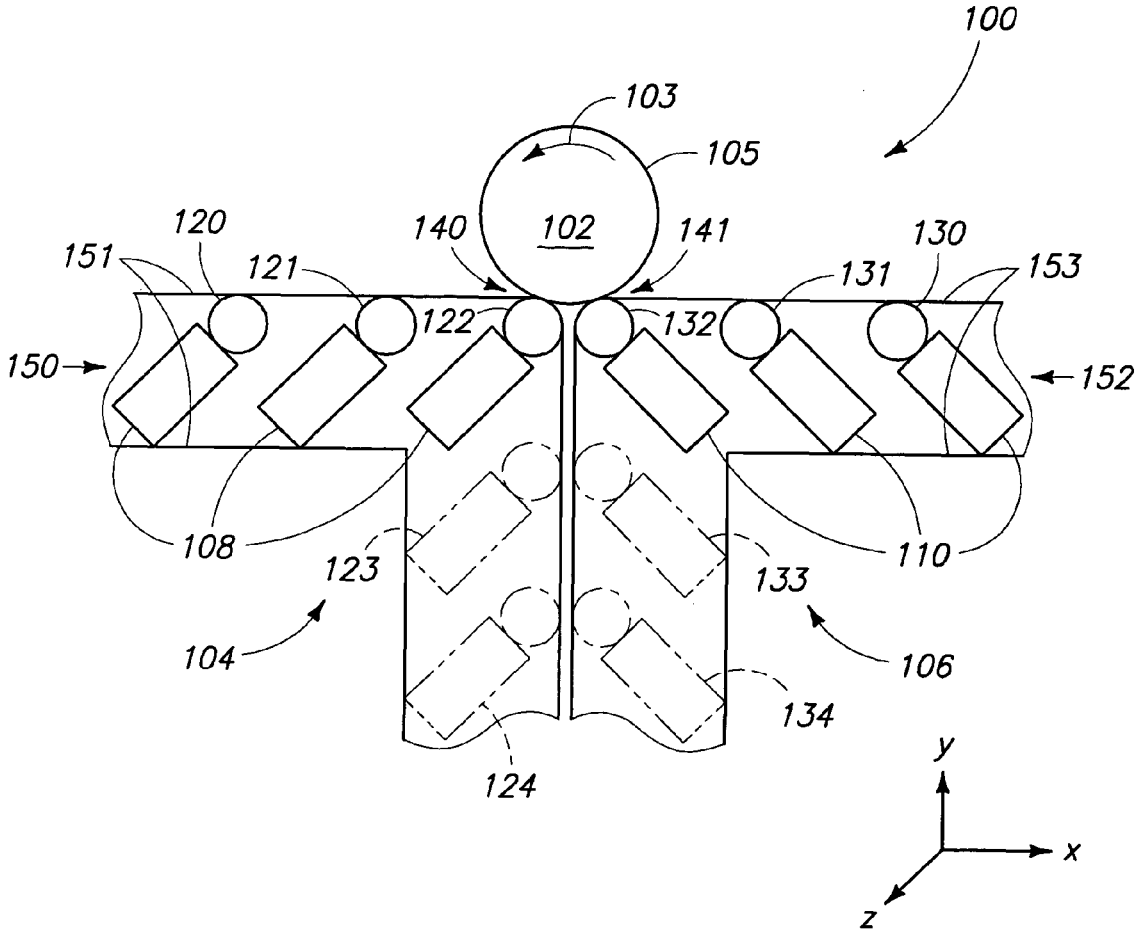
FIG. 9 is an illustrative representation of an imaging apparatus according to one embodiment.

Referring to FIG. 9, another embodiment of an imaging apparatus is illustrated with respect to reference number 100. Imaging apparatus 100 includes a photoconductor 102 and plural sets 104, 106 of respective developers 108, 110 in one exemplary embodiment. A single set of developers may be used in other embodiments. Although not shown in FIG. 9 and similar to the embodiment of FIG. 5 above, the imaging apparatus 100 may include other components for imaging operations such as a charging system, imaging system (e.g., laser), cleaning station, and transfer system, for example.

Photoconductor 102 is configured to rotate in counterclockwise direction as represented by arrow 103 during imaging operations. Photoconductor 102 includes an image forming surface 105 which is configured to receive latent images in at least one embodiment.

Developers 108, 110 are configured to develop latent images upon image forming surface 105 in at least one embodiment. For example, developers 108, 110 may individually provide a respective marking agent (e.g., liquid ink) to image forming surface 105 to develop the latent images. Imaging apparatus 100 may be configured to generate color images in one arrangement and developers 108, 110 may be configured to provide marking agents of respective different colors to enable the formation of color images. In the example of FIG. 9, six different colors may be developed using developers 108, 110. More or less developers 108, 110 may be used to provide more or less colors in other embodiments.

The discussion now proceeds with respect to exemplary operations of developers 108, 110 of respective sets 104, 106 to develop latent images. Exemplary positions of developers 108 of the first set 104 are labeled 120-124 and positions of developers 110 of second set 106 are labeled 130-134 to facilitate the below discussion with respect to exemplary imaging operations of apparatus 100.

Although a plurality of developers 108, 110 are shown in FIG. 9, only one of the developers 108, 110 develops the latent image at a given moment in time in at least one embodiment (e.g., the developer 110 at position 132 does not develop images upon the image forming surface 105 while developer 108 at position 122 develops the images). Further in accordance with the illustrated exemplary embodiment, respective ones of developers 108, 110 are configured to develop the latent images at plural common locations, respectively. More specifically and according to the example of FIG. 9, a first common location 140 corresponds to a nip defined by a developer 108 located at position 122 and photoconductor 102 and a second common location 141 corresponds to a nip defined by a developer 110 located at position 132 and photoconductor 102 in FIG. 9. Developers 108, 110 positioned at respective positions 122, 132 may or may not contact image forming surface 105 to develop images. As mentioned above, only one of the developers 108, 110 develops latent images at a given moment in time in one operational embodiment. As described below, developers 108, 110 may be independently moved to provide the respective development operations of developers 108, 110 at different moments in time.

According to an operational example, developers 108, 110 may alternate development operations to develop a latent image. More specifically, one of developers 108 may apply a marking agent to image forming surface 105 at one moment in time followed by provision of a marking agent to image forming surface by one of developers 110 at a subsequent moment in time (e.g., following development of the latent image by the developer 108 at position 122). The alternating development may continue between developers 108, 110 until a latent image is completely developed whereupon the developed image may be transferred to an intermediate or media.

As shown in the embodiment of FIG. 9, imaging apparatus 100 may include a plurality of respective paths of travel 150, 152 for respective developers 108, 110 and which define the respective developer positions 120-124, 130-134. Tracks 151, 153 or other structure may be used to define paths 150, 152 in exemplary embodiments.

An axial coordinate system (e.g., Cartesian x, y, z coordinates as shown in FIG. 9) may be used to describe movement of developers 108, 110 in one embodiment. As shown, paths 150, 152 guide movement of respective developers 108, 110 in different axial directions in the depicted example (e.g., along x, y axes of movement in one embodiment) to implement development of a latent image by the respective developers 108, 110. The example of FIG. 9 shows different portions of respective paths 150, 152 comprising straight lines normal to one another (i.e., aligned with the x, y axes in the depicted example). The implementing development by a respective developer 108, 110 may include operations of preparing the respective developer 108, 110 to develop a latent image as well as operations after the development by the respective developer 108, 110. For example, implementing development of developers 108, 110 may individually include moving one of developers 108, 110 to one of the respective locations 140, 141 prior to development and/or removing the one of developers 108, 110 from the respective location 140, 141 after the development.

The movement of at least some of developers 108, 110 (i.e., the developers located at positions 121, 131) before and after development by the respective developers occurs in different axial directions in at least one embodiment. Prior to developing a latent image being currently developed, at least some of developers 108, 110 move within respective paths 150, 152 towards the image forming surface 105 of photoconductor 102 regardless of whether the movement is in a forward or rearward direction. After the development, at least some of the developers 108, 110 move away from image forming surface 105 of photoconductor 102.

As mentioned above, the exemplary paths 150, 152 described according to one embodiment move at least some of the developers 108, 110 in different axial directions x, y. Movement in different axial directions may be provided along other suitable paths in other embodiments. For example, movement may be provided along semi-circular paths, combinations of semi-circular and straight portions, or any other appropriate path for moving developers 108, 110 in different axial directions resulting in displacement of developers 108, 110 in different axial directions during implementation of development operations. Although paths 150, 152 are illustrated as symmetrical about the y axis, it is possible in other embodiments to utilize non-symmetrical paths to provide movement of developers 108, 110 of respective sets 104, 106. Further, paths 150, 152 define movement of an individual developer 108, 110 in only a single axial direction at any given moment in time in the example of FIG. 9. In other embodiments, paths 150, 152 may provide movement of an individual developer 108, 110 simultaneously in plural axial directions (e.g., a diagonal path with respect to x, y axes).

Further discussion now proceeds with respect to development of a latent image using plural developers 108, 110 which are configured to alternate development according to one embodiment shown in FIG. 9. One of developers 108 located at position 122 may initially develop the latent image. Thereafter, the developer 110 at position 132 may develop the latent image. While the developer 110 develops at position 132, the developer 108 which just completed development may move in a first direction (e.g., −y direction) to positions 123 and/or 124 while developers 108 located at positions 120, 121 move in a second direction (e.g., +x direction) to positions 121, 122, respectively. Following development of the developer 110 at position 132, the developer 108 now located at position 122 may develop the latent image while the developer 110 which just completed development moves in the −y direction to positions 133 and/or 134 and the remaining developers 110 move in the −x direction to respective positions 131, 132 to prepare for subsequent development. The development continues to alternate between developers 108, 110 until the latent image is developed using all of the colors according to the described embodiment. After development by the developers 108, 110, the developed image may be provided for transfer to media either directly or using an intermediate, for example.

After development of a first image by all of the developers 108, 110, developers 108 are located at positions 122-124 and developers are located at positions 132-134. According to one embodiment, the developers 108, 110 may thereafter develop a next latent image upon image forming surface 105 in reverse alternating order and return to respective positions 120-122, 130-132. To develop the next latent image, developers 108, 110 located at positions 122-124, 132-134 may move in directions opposite to those in which the respective developers moved during the development of the previous latent image (e.g., a developer at position 123 may move in the +y direction and the −x direction). Accordingly, developers 108, 110 may move back and forth along respective paths 150, 152 to develop the latent images in one embodiment.

The protection sought is not to be limited to the disclosed embodiments, which are given by way of example only, but instead is to be limited only by the scope of the appended claims.

What is claimed is:

1. An imaging apparatus comprising:

an image forming surface to form thereon a latent electrostatic image;

a plurality of developer surfaces to operatively engage the image forming surface at a first development region;

a plurality of developers each comprising one of the developer surfaces, which transfer toner from the respective developer surface to the image forming surface to form a developed image on the image forming surface;

wherein the plurality of developers are adapted to move with respect to the image forming surface to sequentially bring each of the plurality of developer surfaces into operative engagement with the image forming surface, at the first development region;

wherein each of the plurality of developers is adapted to individually move relative to the remaining developers during transfer of the toner from a respective developer surface of a different one of the developers to the image forming surface;

wherein one of the developers is configured to move during transfer of the toner from the respective developer surface of another of the developers to the image forming surface to form the developed image;

wherein each of the plurality of developers is to shuttle move from an inoperative position prior to engagement of the respective developer surface with the image forming surface, to an operative position where the respective developer surface operatively engages the image forming surface at the first development region, and thereafter to a further inoperative position, following engagement of the respective developer surface with the image forming surface; and wherein the plurality of developers are linearly arranged when disengaged, substantially tangential to the image forming surface at the first development region.

2. The apparatus according to claim 1, further comprising means to transfer the developed image from the image forming surface to a final substrate.

3. The apparatus according to claim 1, further comprising a plurality of applicator assemblies for forming the layer of toner onto the respective developer surfaces.

4. An imaging apparatus comprising an image forming surface to form thereon a latent electrostatic image;

a plurality of developer surfaces to operatively engage the image forming surface at a first development region;

a plurality of developers each comprising one of the developer surfaces, which transfer toner from the respective developer surface to the image forming surface to form a developed image on the image forming surface; and a plurality of carousel assemblies to rotatably mount the plurality of developers, wherein a first of the plurality of carousel assemblies is arranged and adapted to move with respect to the image forming surface, and to sequentially bring a first subset of the plurality of developer surfaces into operative engagement with the image forming surface, at the first development region;

wherein the plurality of developers are to move with respect to the image forming surface to sequentially bring each of the plurality of developer surfaces into operative engagement with the image forming surface, at the first development region;

wherein each of the plurality of developers is to individually move relative to the remaining developers during transfer of the toner from a respective developer surface of a different one of the developers to the image forming surface;

wherein one of the developers is configured to move during transfer of the toner from the respective developer surface of another of the developers to the image forming surface to form the developed image;

wherein each of the plurality of carousel assemblies is to shuttle move to and from a position directly adjacent the first development region of the image forming surface; and wherein the plurality of carousel assemblies are arranged in a straight line, substantially tangential to the image forming surface at the first development region.

5. The apparatus according to claim 4, wherein the plurality of carousel assemblies are arranged in a straight line, substantially tangential to the image forming surface at the first development region.

6. The apparatus according to claim 5, wherein each carousel assembly is rotatable to move each of the developers, in turn, from an inoperative position prior to engagement of the respective developer surface with the image forming surface, to an operative position where the respective developer surface operatively engages the image forming surface at the first development region, and thereafter to a further inoperative position, following engagement of the respective developer surface with the image forming surface.

7. The apparatus according to claim 6, wherein the plurality of carousel assemblies includes two carousel assemblies.

8. The apparatus according to claim 7, wherein development of the developed image on the image forming surface alternates between the two carousel assemblies.

9. The apparatus according to claim 4, wherein each carousel assembly further comprises one or more applicator assemblies mounted adjacent the developers to form the layer of toner onto the respective developer surfaces.

10. The apparatus according to claim 4, wherein the image forming surface further comprises a second development region which is fixed in a spatial position, spaced from the first development region.

11. The apparatus according to claim 10, wherein a second of the plurality of carousel assemblies is configured to bring a second subset of the plurality of developer surfaces into operative engagement with the image forming surface, at the second development region.

12. The apparatus according to claim 11, wherein each of the first and second carousel assemblies is rotatable to move each of the developers, in turn, from an inoperative position prior to engagement of the respective developer surface with the image forming surface, to an operative position where the respective developer surface operatively engages the image forming surface at corresponding one of the first and second development regions, and thereafter to a further inoperative position, following engagement of the respective developer surface with the image forming surface.

13. An imaging apparatus comprising:

a photoconductor comprising an image forming surface configured to receive a latent image;

a plurality of developers individually configured to provide a marking agent to the image forming surface to develop the latent image, wherein one of the developers is configured to move in a first direction with respect to the image forming surface to implement development of the latent image by the one of the developers and an other of the developers is configured to move in a second direction different than the first direction to implement development of the latent image by the other of the developers;

wherein the photoconductor is configured to provide a developed image corresponding to the latent image for transfer to media after the development of the latent image by the one and other developers; and wherein a first of the developers is configured to move during development of the latent image using a second of the developers.

14. The apparatus of claim 13, wherein the movements in the first and the second directions comprise movements of the one and other developers in different axial directions of an axial coordinate system.

15. The apparatus of claim 13, wherein the first and second directions are substantially normal to one another.

16. The apparatus of claim 13, wherein the first and second directions comprise directions in straight lines.

17. The apparatus of claim 13, wherein individual ones of the developers move at different moments in time.

18. The apparatus of claim 13, wherein the one of the developers is configured to move in a direction opposite to the first direction to develop an other latent image and the other of the developers is configured to move in a direction opposite to the second direction to develop the other latent image.

19. The apparatus of claim 13, wherein the developers are individually configured to develop the latent image at a common location adjacent to the image forming surface at different moments in time.

20. The apparatus of claim 13, wherein yet another of the developers moves in both of the first and second directions to implement development of the latent image by the yet another of the developers.

21. The apparatus of claim 20, wherein the yet another developer is configured to move in the first direction towards the photoconductor and to move in the second direction away from the photoconductor.

22. The apparatus of claim 13, wherein the developers comprise initial developers of a first set, and further comprising a second set of additional developers, and wherein one of the additional developers is configured to move in the second direction to implement development of the latent image using the one of the additional developers, and an other of the additional developers is configured to move in a third direction different than the first and second directions to implement the development of the latent image using the other of the additional developers.

23. The apparatus of claim 22, wherein the initial developers are configured to develop the latent image at a first common location adjacent to the image forming surface and the additional developers are configured to develop the latent image at a second common location adjacent to the image forming surface and different than the first location.

24. The apparatus of claim 13, wherein the developers are individually configured to provide a liquid marking agent to develop the latent image.

25. The apparatus of claim 13, wherein the developers are individually configured to provide a marking agent comprising one of a plurality of different colors to develop the latent image.

26. The apparatus of claim 13, wherein the photoconductor is configured to directly transfer the developed image to the media.

27. An image forming method comprising:

providing a latent image upon an image forming surface of a photoconductor;

developing the latent image using a plurality of developers providing a developed image, and wherein, for an individual one of the developers, the developing comprises moving the individual developer in a first direction towards the image forming surface of the photoconductor to develop the latent image, and moving the individual developer in a second direction different than the first direction away from the image forming surface and wherein the developing comprises developing using plural ones of the developers positioned adjacent to different locations of the image forming surface of the photoconductor and developing the latent image using some of the developers positioned at a common location adjacent to the image forming surface;

transferring the developed image to media; and wherein the movings in the first and the second directions comprise movings in different axial directions of an axial coordinate system.

28. The method of claim 27, wherein the first and second directions are substantially normal to one another.

29. The method of claim 27, wherein the first and second directions comprise directions in straight lines.

30. The method of claim 27, wherein the developing comprises developing using a liquid marking agent of the developers.

31. The method of claim 27, wherein the developing comprises developing using marking agents of the developers comprising a plurality of different colors.

32. The method of claim 27 further comprising moving a first of the developers while developing using a second of the developers.

33. An imaging apparatus comprising:

a photoconductor comprising an image forming surface configured to receive a latent image;

a plurality of developers individually configured to provide a marking agent to the image forming surface to develop the latent image, wherein one of the developers is configured to move in a first direction with respect to the image forming surface to implement development of the latent image by the one of the developers and an other of the developers is configured to move in a second direction different than the first direction to implement development of the latent image by the other of the developers;

wherein the photoconductor is configured to provide a developed image corresponding to the latent image for transfer to media after the development of the latent image by the one and other developers;

wherein the movements in the first and the second directions comprise movements of the one and other developers in different axial directions of an axial coordinate system; and wherein a first of the developers is configured to move during provision of the marking agent by a second of the developers to the image forming surface to develop the latent image.

34. An imaging apparatus comprising:

a photoconductor comprising an image forming surface configured to receive a latent image;

a plurality of developers individually configured to provide a marking agent to the image forming surface to develop the latent image, wherein one of the developers is configured to move in a first direction with respect to the image forming surface to implement development of the latent image by the one of the developers and an other of the developers is configured to move in a second direction different than the first direction to implement development of the latent image by the other of the developers;

wherein the photoconductor is configured to provide a developed image corresponding to the latent image for transfer to media after the development of the latent image by the one and other developers; and wherein the first and second directions are normal to one another.

35. The apparatus of claim 34 wherein a first of the developers is configured to move during provision of the marking agent by a second of the developers to the image forming surface to develop the latent image.

36. An imaging apparatus comprising:

a photoconductor comprising an image forming surface configured to receive a latent image;

a plurality of developers individually configured to provide a marking agent to the image forming surface to develop the latent image, wherein one of the developers is configured to move in a first direction with respect to the image forming surface to implement development of the latent image by the one of the developers and an other of the developers is configured to move in a second direction different than the first direction to implement development of the latent image by the other of the developers;

wherein the photoconductor is configured to provide a developed image corresponding to the latent image for transfer to media after the development of the latent image by the one and other developers; and wherein the developers comprise first developers of a first set, and further comprising a second set of second developers, and wherein one of the second developers is configured to move in the second direction to implement development of the latent image using the one of the second developers, and an other of the second developers is configured to move in a third direction different than the first and second directions to implement the development of the latent image using the other of the second developers.

37. The apparatus of claim 36 wherein the first developers are configured to develop the latent image at a first common location adjacent to the image forming surface and the second developers are configured to develop the latent image at a second common location adjacent to the image forming surface and different than the first location.

38. An image forming method comprising:

providing a latent image upon an image forming surface of a photoconductor;

developing the latent image using a plurality of developers providing a developed image, and wherein, for an individual one of the developers, the developing comprises moving the individual developer in a first direction towards the image forming surface of the photoconductor to develop the latent image, and moving the individual developer in a second direction different than the first direction away from the image forming surface;

transferring the developed image to media; and wherein the movings in the first and the second directions comprise movings in different axial directions of an axial coordinate system.

39. The method of claim 38 wherein the movings comprise moving a first of the developers during the developing the latent image using a second of the developers.

40. An image forming method comprising:

providing a latent image upon an image forming surface of a photoconductor;

developing the latent image using a plurality of developers providing a developed image, and wherein, for an individual one of the developers, the developing comprises moving the individual developer in a first direction towards the image forming surface of the photoconductor to develop the latent image, and moving the individual developer in a second direction different than the first direction away from the image forming surface;

transferring the developed image to media; and wherein the first and second directions are substantially normal to one another.

41. The method of claim 40 wherein the movings comprise moving a first of the developers during the developing the latent image using a second of the developers.

42. An imaging apparatus comprising:

a photoconductor comprising an image forming surface configured to receive a latent image;

a plurality of developers individually configured to provide a marking agent to the image forming surface to develop the latent image, wherein one of the developers is configured to move in a first direction with respect to the image forming surface to implement development of the latent image by the one of the developers and an other of the developers is configured to move in a second direction different than the first direction to implement development of the latent image by the other of the developers;

wherein the photoconductor is configured to provide a developed image corresponding to the latent image for transfer to media after the development of the latent image by the one and other developers;

wherein the first and second directions are substantially normal to one another; and wherein a first of the developers is configured to move during provision of the marking agent by a second of the developers to the image forming surface to develop the latent image.

* * * * *